US009784013B2

(12) United States Patent
Ben-Aharon et al.

(10) Patent No.: US 9,784,013 B2
(45) Date of Patent: Oct. 10, 2017

(54) ELIMINATING MAXIMUM ADJACENT CUT SPECIFICATION RESTRICTIONS FOR TELESCOPING PINS

(71) Applicant: MUL-T-LOCK TECHNOLOGIES LTD., Yavne (IL)

(72) Inventors: Effi Ben-Aharon, Hod HaSharon (IL); Izhak Kaiser, Petach Tikva (IL); Zvi Frenkel, Petach Tikva (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 196 days.

(21) Appl. No.: 14/758,832

(22) PCT Filed: Dec. 4, 2013

(86) PCT No.: PCT/US2013/072945
§ 371 (c)(1),
(2) Date: Jul. 1, 2015

(87) PCT Pub. No.: WO2014/107254
PCT Pub. Date: Jul. 10, 2014

(65) Prior Publication Data

US 2015/0345177 A1 Dec. 3, 2015

(51) Int. Cl.
*E05B 19/00* (2006.01)
*E05B 27/00* (2006.01)

(52) U.S. Cl.
CPC ..... *E05B 19/0017* (2013.01); *E05B 19/0023* (2013.01); *E05B 19/0035* (2013.01);
(Continued)

(58) Field of Classification Search
CPC ..... Y10T 70/7842; E05B 27/0017; E05B 19/0017; E05B 19/0023; E05B 19/0035;
(Continued)

(56) References Cited

U.S. PATENT DOCUMENTS 5,819,566 A * 10/1998 Eden, Jr. ..... E05B 27/0042 70/358
6,516,644 B1 * 2/2003 Seliber ..... E05B 27/0053 70/340

(Continued)

FOREIGN PATENT DOCUMENTS

IL GB 2412689 A * 10/2005 ..... E05B 27/0042
WO 04/001165 12/2003

(Continued)

OTHER PUBLICATIONS

PCT Written Opinion, PCT/US2013/072945, Aug. 5, 2014.

*Primary Examiner* — Suzanne Barrett
(74) *Attorney, Agent, or Firm* — Dekel Patent Ltd.; David Klein

(57) ABSTRACT

A key device (10) includes a generally elongate shaft portion (12) including a key combination surface (16) that has a plurality of key cut stations (18) for forming telescoping key cuts at each key cut station (18). Each key cut station (18) has a telescoping maximum adjacent cut specification (MACS) that defines a maximum depth of adjacent. The key device (10) also has a non-MACS key cut (20), formed at one or more of the key cut stations (18), for interfacing with a first pin (24) of a given telescoping plug pin. The non-MACS key cut (20) is dimensioned to leave material in the elongate shaft portion (12) for forming another key cut (20A) for interfacing with a second pin (26) of the given telescoping plug pin.

13 Claims, 6 Drawing Sheets

(52) U.S. Cl.
CPC ..... *E05B 19/0058* (2013.01); *E05B 27/0003* (2013.01); *E05B 27/0017* (2013.01); *E05B 27/0021* (2013.01); *Y10T 70/7531* (2015.04); *Y10T 70/7842* (2015.04)

(58) Field of Classification Search
CPC ..... E05B 19/0058; E05B 27/0003; E05B 27/0021
USPC ..... 70/409, 405, 490
See application file for complete search history.

(56) References Cited

U.S. PATENT DOCUMENTS

| | | | | |
|---|---|---|---|---|
| 2006/0207303 | A1* | 9/2006 | Almagor | E05B 19/0023 70/493 |
| 2009/0301144 | A1* | 12/2009 | Herman | E05B 27/0053 70/1 |
| 2011/0146360 | A1* | 6/2011 | Ben-Aharon | E05B 35/003 70/490 |
| 2013/0091910 | A1* | 4/2013 | Dolev | E05B 27/0017 70/406 |
| 2013/0327102 | A1* | 12/2013 | Ben-Aharon | E05B 27/0042 70/493 |

FOREIGN PATENT DOCUMENTS

| | | |
|---|---|---|
| WO | 2004/048724 | 6/2004 |
| WO | 2009/019726 | 2/2009 |
| WO | 2010/026381 | 3/2010 |

* cited by examiner

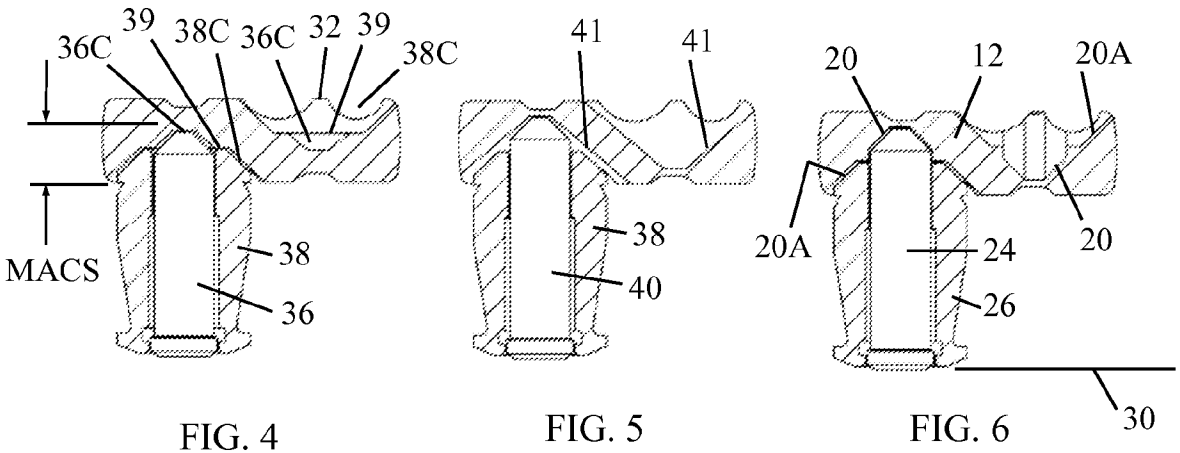
FIG. 4
FIG. 5
FIG. 6
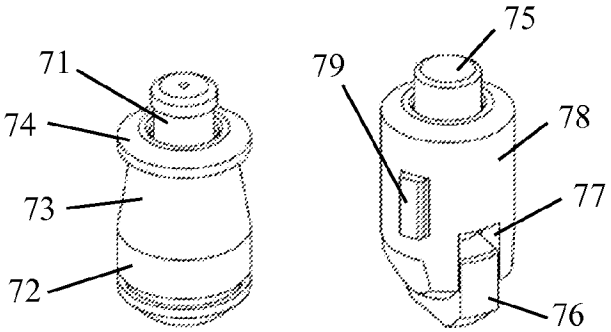
FIG. 7A
FIG. 7B

ELIMINATING MAXIMUM ADJACENT CUT SPECIFICATION RESTRICTIONS FOR TELESCOPING PINS

FIELD OF THE INVENTION

The present invention relates to locking apparatus generally and more particularly to eliminating the maximum adjacent cut specification of key cuts for telescoping pins.

BACKGROUND OF THE INVENTION

As is well known in the art, cylinder locks generally include a plug arranged for rotation in a lock cylinder housing. Plug pins are slidingly disposed in the plug and are arranged to move against driver pins, which are disposed in bores formed in the cylinder housing and are spring biased toward the axis of the plug rotation. Insertion of a properly cut key in a keyway provided in the plug moves the plug pins against the driver pins and aligns all the pins along a shear line defined by the plug outer circumference, thereby permitting rotation of the plug to cause operation of a latch or locking mechanism.

The combination of key cuts that correctly move all the plug pins to the shear line is commonly referred to as bitting. Lock/key manufacturers typically define the bitting in order to have a large number of possible combinations while still maintaining a secure, functional and durable key. The key cuts have a range of depth, ranging from the shallowest possible cut to the deepest possible cut. Another parameter is the spacing between key cuts, i.e., the distance from the center of one cut to the center of an adjacent cut. Each key cut is designed to move one plug pin at discrete plug pin locations, also referred to as plug pin stations. Each plug pin moves in a discrete bore formed in the plug.

Some keys are made for interacting with telescoping pins. In such a case, each telescoping plug pin has two or more pins that move independently of each other. For telescoping plug pins, the key cuts formed in the key overlap each other to some extent. Each key cut moves a different one of the pins that make up the telescoping pin to the shear line.

Key cuts are typically made by a key cutting or duplicating machine that machines cuts into a key blank. The machining operation is typically done by a cutting tool with sloped sides that cuts into the key blank. The key cut thus has sloping sides. This is also true for tools that stamp the cuts into the key blank.

Lock/key manufacturers typically define a maximum adjacent cut specification (MACS). That is, it is normally not possible to have a large difference in key cut depth between neighboring cut positions. See, for example, U.S. Patent Applications 20090277239 and 20090301144 assigned to Ingersoll-Rand Company, which clearly state that a key cut that violates the MACS is not an available key cut.

The general idea of MACS is explained with reference to FIG. 1; the telescoping case will be explained afterwards with reference to FIG. 1A. A key 1 is shown with two adjacent key cuts 2 and 3 for moving plug pins 4 and 5 of different lengths to a shear line 6. Let us examine what happens if a deeper cut 7 (as shown by the broken line) were to be made instead of key cut 3. Because the key cutting tool has sloping sides, the tool width extends laterally beyond the center position of the deeper cut and removes key material from the adjacent shallower cut. As a result, the plug pin 4, which was meant for the shallower cut, will not sit at the correct depth; rather it will sit deeper than it should (as shown by the broken line 8) because of the material that has been cut away by cutting the adjacent key cut. The plug pin 4 will not be positioned at the shear line 6 but rather at a line 9 (broken line in the drawing) and the plug will not turn.

Another reason for the MACS limitation is to ensure easy insertion or removal of the key. When the key is inserted into the cylinder lock, the plug pins ride up and down the ramps between cuts. If the angle is too steep, the pins can have trouble riding the ramps and the key can get jammed.

Without limitations to the present invention, the MACS may be generally calculated for the above as follows:

$$MACS = \frac{SP - CR}{DI\left(\tan\frac{CA}{2}\right)}$$

wherein SP=pin spacing (spacing between plug pins to be operated by the key)

CR=cut root (length of the bottom ("root") of the key cut)

DI=depth increment

CA=cut angle (angle of the cutting tool head used to create the key cuts)

Reference is now made to FIG. 1A, which illustrates the MACS for telescoping pins (e.g., inner and outer pins) of a telescoping plug pin of a cylinder lock plug (referred to as the telescoping MACS). Each of the inner and outer pins has a chamfer, that is, a conical tip. This means the shaft of each pin has an outer diameter which is larger than the diameter of the shaft tip.

Although the invention is not limited to this definition, the MACS for a telescoping pin may be calculated as follows:

$$MACS = \frac{ID - CR}{2DI\left(\tan\frac{CA}{2}\right)}$$

wherein ID=the outside diameter of the inner telescoping pin

The telescoping MACS sets a limit for possible depths of adjacent cuts, and thereby reduces the number of possible key cut combinations.

Efforts have been made in the prior art to increase the MACS for non-telescoping pins. For example, in U.S. Patent Application 20120240646 (corresponding to PCT Application PCT/SE2010/051405), assigned to ASSA OEM AB, Sweden, conical angles of grooves which serve as the key cuts have been changed. In other words, the above formula for MACS still applies; this document simply changes the cut angle CA. All the key cuts are still defined and restricted by the same MACS definition.

SUMMARY OF THE INVENTION

The present invention seeks to provide methods and structure for eliminating the maximum adjacent cut specification of key cuts for telescoping pins, as is described more in detail hereinbelow. The prior art has labored under an assumption of how the key cuts are made in determining the MACS, using a symmetric conical angle cutting tool. The present invention succeeds in making one or more of the telescoping key cuts in a manner contrary to the underlying assumption of the prior art MACS for telescoping pins, thereby eliminating the restrictions of the MACS. The may enable making key cuts that are deeper than the prior art definition of telescoping MACS, for example. The non- MACS key cut for a given telescoping pin is defined as a key cut that is not restricted by the telescoping MACS definition for that given telescoping pin.

There is thus provided in accordance with an embodiment of the present invention a key device (key blank or key) including a generally elongate shaft portion including a key combination surface that has a plurality of (e.g., axially spaced) key cut stations for forming telescoping key cuts at each key cut station, each key cut station having a telescoping maximum adjacent cut specification (MACS) that defines a maximum depth of adjacent, telescoping key cuts for interfacing with pins of a telescoping plug pin of a cylinder lock plug, and a non-MACS key cut, formed at at least one of the key cut stations for interfacing with a first pin of a given telescoping plug pin, dimensioned to leave material in the elongate shaft portion for forming another key cut for interfacing with a second pin of the given telescoping plug pin.

In one embodiment, the key has both regular key cuts cut according to the MACS plus one or more non-MACS key cuts. In another embodiment, the key has only one or more non-MACS key cuts with no key cuts cut according to the MACS.

Embodiments of the invention may include one or more of the following non-limiting features. For example, the non-MACS key cut may have a larger dimension (e.g., depth deeper) than the MACS. The non-MACS key cut is formed for interfacing with an inner pin of the given telescoping plug pin. The non-MACS key cut is dimensioned for supporting the first pin at a shear line. The key combination surface includes a support surface on which the telescoping key cuts are at least partially formable, and the non-MACS key cut is formed on the support surface. The non-MACS key cut is dimensioned to leave material away from the support surface for forming the other key cut for interfacing with the other pin of the telescoping plug pin. The non-MACS key cut may include a longitudinal concave furrow formed in the elongate shaft portion.

The key blank may be formed into a key by making telescoping key cuts on the elongate shaft portion at the key cut stations away from the non-MACS key cut. The elongate shaft portion may have another key cut formed at the key cut station of the non-MACS key cut for interfacing with the second pin of the given telescoping plug pin.

BRIEF DESCRIPTION OF THE DRAWINGS

The present invention will be understood and appreciated more fully from the following detailed description, taken in conjunction with the drawings in which:

FIGS. 2A, 2B, 2C and 3A, 3B and 3C are simplified pictorial and top view illustrations, respectively, of key devices with non-central support structure for one or more pins (in this case, outer pins) of telescoping plug pins, constructed and operative in accordance with an embodiment of the present invention, wherein FIG. 2A is a key with a non-MACS key cut and other key cuts formed thereon, FIG. 2B is a key blank with a non-MACS key cut formed thereon whose ends are tapered inwards, and FIG. 2C is a key blank with a non-MACS key cut formed thereon which is wider than that of FIG. 2B up to its ends and whose ends terminate with a central protrusion;

FIG. 4 is a simplified sectional illustration of any of the key devices of FIGS. 2A-3C, showing a telescoping plug pin supported at a support surface for the outer pin of the telescoping plug pin, the section taken along lines IV-IV in FIG. 3A;

FIG. 5 is a simplified sectional illustration of the key device of FIGS. 2A-3C, the section taken along lines IV-IV in FIG. 3A, showing a telescoping plug pin, having a longer inner pin than that of FIG. 4, and with key cuts made on the central support structure for both the inner and outer pins of the telescoping plug pin;

FIG. 6 is a simplified sectional illustration of the key device of FIGS. 2A-3C, the section taken along lines VI-VI in FIG. 3A, showing a telescoping plug pin, having a longer inner pin than that of FIG. 4 like that of FIG. 5, but this time with a key cut made on the non-central support structure for the outer pin and a key cut made on the central support structure for the inner pin, the key cut for the inner pin being deeper than that of FIG. 4 but the key cut for the outer pin being the same depth as the key cut for the outer pin in FIG. 4;

FIGS. 7A and 7B are simplified pictorial illustrations of two telescoping pins which may be moved by the key devices of the present invention.

DETAILED DESCRIPTION OF EMBODIMENTS

Reference is now made to FIGS. 2A-3C, which illustrate a key device 10, constructed and operative in accordance with a non-limiting embodiment of the present invention.

It is noted that throughout the specification and claims the term "key device" refers to a key blank or a key made from a key blank with key cuts formed thereon. Key device 10 is illustrated as a key blank in FIGS. 2B, 2C, 3B and 3C.

Key device 10 includes a generally elongate shaft portion (key blade) 12 having a surface with key cuts 14 (FIGS. 2A and 3A) formed thereon that define a key combination surface 16, as is known in the art. The key cuts 14 are cut for interfacing with telescoping plug pins, this term encompassing any type of pin that includes at least one inner pin and at least one outer pin that move with respect to each other.

Key device 10 may define a reversible key, with symmetric key combination surfaces. (FIGS. 4-6 show reversible keys.) Alternatively, key device 10 may have a single key combination surface or different key combination surfaces.

Figure 1A:
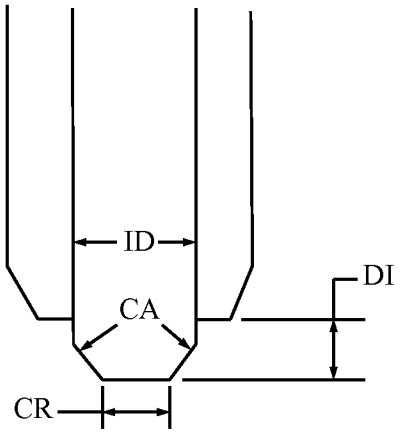
FIG. 1A PRIOR ART
FIG. 1A is a simplified illustration of a prior art key showing the MACS limitation for inner and outer pins of a telescoping pin.
Figure 1:
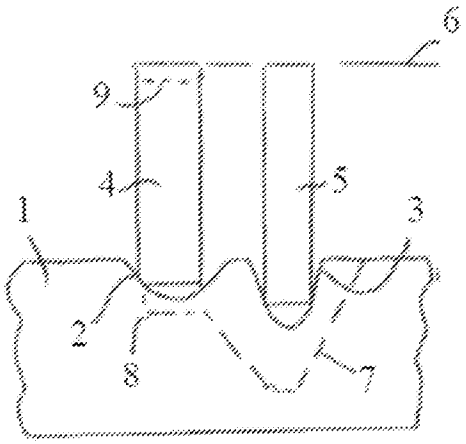
FIG. 1 PRIOR ART
FIG. 1 is a simplified illustration of a prior art key showing the MACS limitation for adjacent key cuts.
Figures 2A, 2B, 2C:
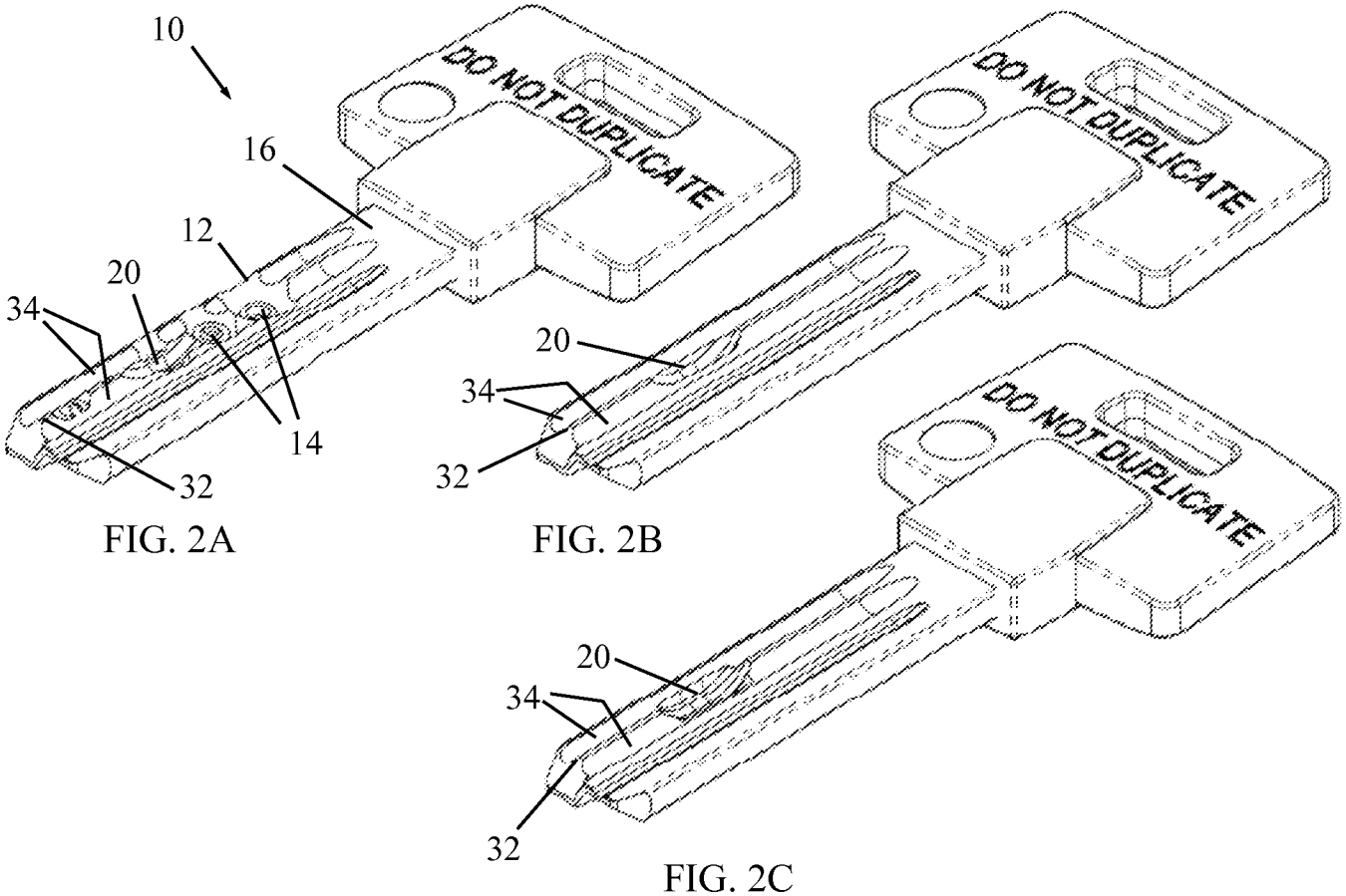

Key combination surface 16 has a plurality of key cut stations 18 (FIGS. 3A and 3B) for forming telescoping key cuts 14 at each key cut station 18. The key cut stations 18 may be axially spaced from each other, but alternatively may be spaced in other directions. Each key cut station 18 has a telescoping maximum adjacent cut specification (MACS) (seen in FIG. 4), which defines a maximum depth of adjacent key cuts for interfacing with telescoping pins of a telescoping plug pin of a cylinder lock plug, as explained above with reference to FIG. 1A.

In accordance with an embodiment of the present invention, a non-MACS key cut 20 (also referred to as a special key cut) is formed at one or more key cut stations 18 (FIGS. 2A-3C and 6). Key cut 20 is called a "non-MACS key cut 20" because it is not restricted by the telescoping MACS definition for a given telescoping pin 22; it is formed in a manner that is contrary to the telescoping MACS definition used for making the other, conventional key cuts. As seen in FIG. 6, non-MACS key cut 20 is arranged to interface with telescoping pin 22 that has two pins, one nested in the other. More specifically, non-MACS key cut 20 interfaces with a first pin 24 (in the illustrated embodiment, this is the inner pin 24) of this given telescoping pin 22. The elongate shaft portion 12 has another key cut 20A formed at the key cut station of non-MACS key cut 20 for interfacing with a second pin 26 (in the illustrated embodiment, this is the outer pin 26) of this given telescoping pin 22 (that is, key cut 20A and non-MACS key cut 20 interact with the different telescoping pins that make up the same given telescoping plug pin). In the illustrated embodiment, the non-MACS key cut 20 has a depth deeper than the depth defined by the MACS, easily seen by comparing FIGS. 4 and 6. Alternatively, non-MACS key cut 20 does not have to be deeper than the MACS. Non-MACS key cut 20 is dimensioned (configured) to leave material in elongate shaft portion 12 for forming key cut 20A. Non-MACS key cut is dimensioned for supporting the first pin 24 at a shear line 30 (FIGS. 6 and 8).

In an alternate embodiment of the invention, non-MACS key cut 20 may be fashioned to interface with the outer pin of the telescoping pin.

In a non-limiting embodiment of the invention, as seen in FIGS. 2A-3C, key combination surface 16 includes a support surface 32 on which the telescoping key cuts 14 are at least partially formable. Non-MACS key cut 20 is formed in support surface 32, too. Without limitation, support surface 32 can be raised, lower or flush with surface 16. In the illustration, axial grooves 34 are formed in key combination surface 16 near support surface 32, but the invention does not require such grooves. The illustrated non-MACS key cut 20 includes a longitudinal concave furrow formed in elongate shaft portion 16. This formation allows for easy insertion or removal of the key in the cylinder lock, so that the plug pins ride up and down easily on the ramps between key cuts.

Figures 3A, 3B, 3C:
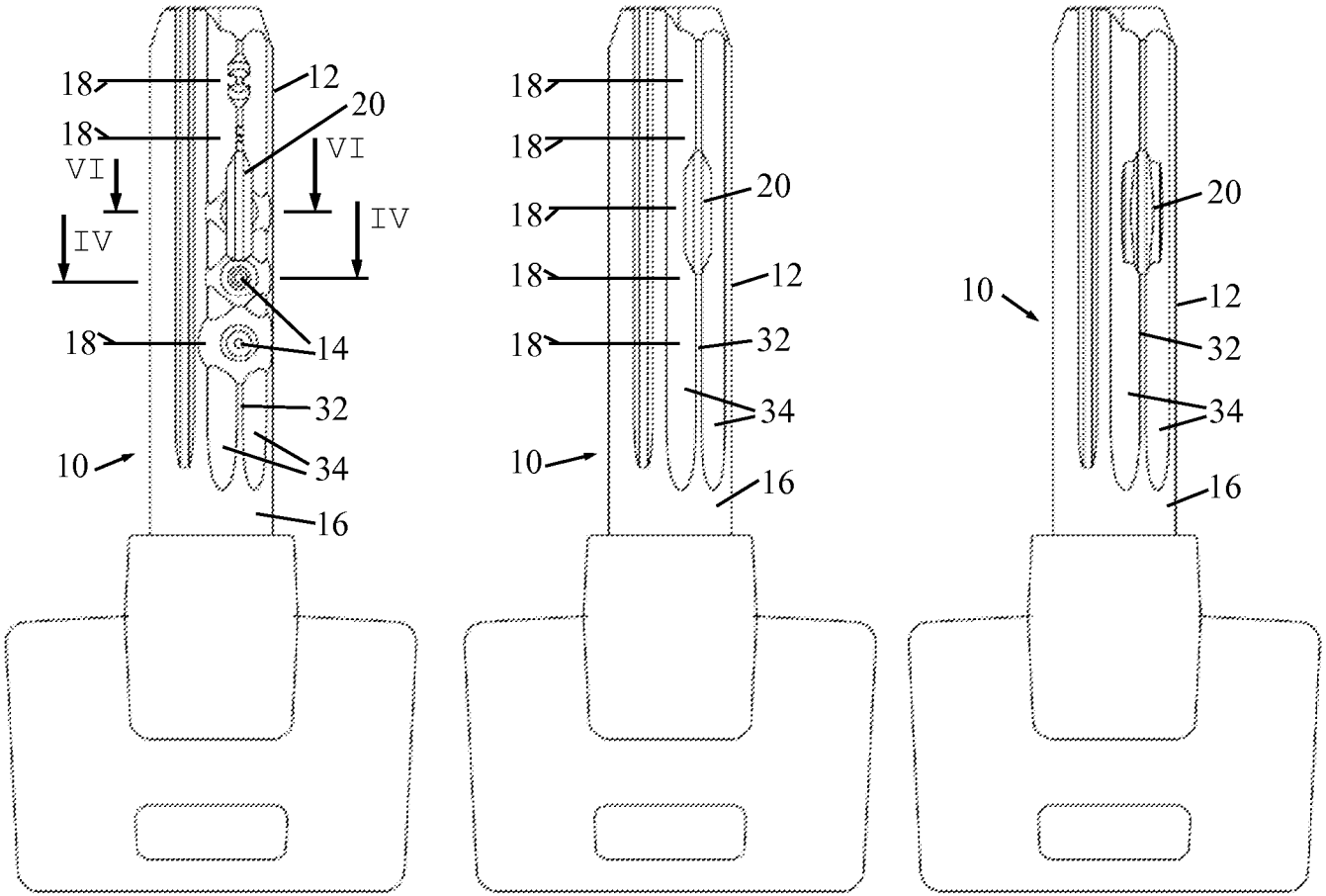
Figure 3D:
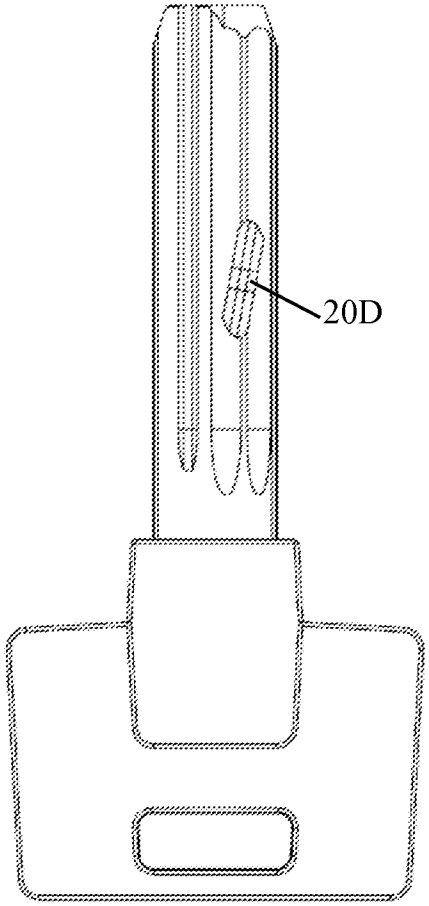
FIG. 3D is a simplified top-view illustration of a key blank with a non-MACS key cut which is tilted with respect to the longitudinal axis of the elongate shaft portion of the key blank.

In the above embodiments, the non-MACS key cut is aligned with, or parallel to, the longitudinal axis of the elongate shaft portion of the key or key blank. FIG. 3D illustrates an alternative, in which a non-MACS key cut 20D is tilted with respect to the longitudinal axis of the elongate shaft portion of the key blank.

One of the important significances of the invention can be appreciated by comparing FIGS. 4-6, as is now explained.

FIG. 4 shows an inner pin 36 of a telescoping plug pin supported by an inner key cut 36C and an outer pin 38 supported by an outer key cut 38C formed over inner cut 36C. Note that outer pin 38 is supported by a shoulder 39 of outer key cut 38C. Both key cuts 36C and 38C are formed over support surface 32.

FIG. 5 shows a telescoping plug pin having a longer inner pin 40 than inner pin 36 of FIG. 4. Instead of making a non-MACS key cut, a conventionally formed key cut 41 has been made in an attempt to support the extra-long inner pin 40. This results in destroying the shoulder of the outer key cut which was seen in FIG. 4, so that the inner and outer key cuts blend into one key cut 41. The result is the outer pin 38 will not be positioned anymore at the shear line.

In FIG. 6, inner pin 24 has the same length as extra-long inner pin 40 of FIG. 5. However, non-MACS key cut 20 is made on the support surface for inner pin 24, whereas the outer pin 26 is supported on the non-central support surface (that is, the material left on the sides—lateral sides, not the longitudinal sides of support surface 32 in FIGS. 2A-3C). All pins of the telescoping pin are positioned correctly at the shear line and the MACS depth has been increased. This increases the possible key combinations.

FIGS. 7A and 7B illustrate two non-limiting examples of telescoping pins which may be moved by the key devices of the present invention. In FIG. 7A, inner 71 and outer 72 telescoping pins are generally round. The outer pin 72 has a conical portion 73 and a rim 74. In FIG. 7B, an inner pin 75 has a non-round (e.g., chisel) end 76 and is constrained to move in a slot 77 formed in an outer pin 78; inner pin 75 cannot rotate with respect to outer pin 72. Outer pin 78 has one or more lugs 79 that prevent outer pin 78 from rotating.

Figure 8B:
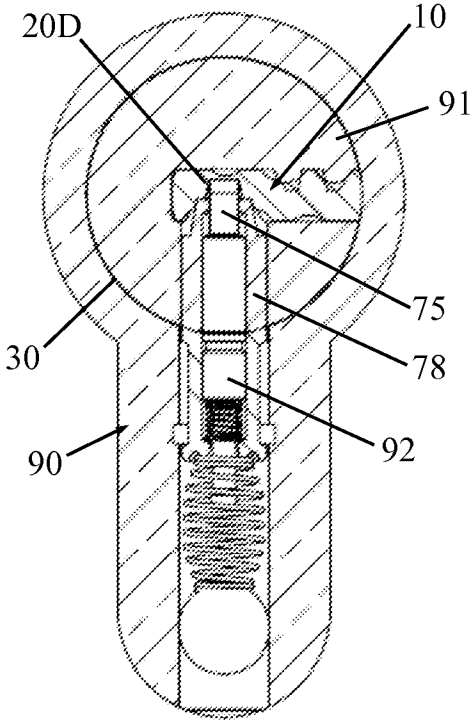
FIGS. 8A and 8B are simplified sectional illustrations of the key device of FIGS. 2A-3C and of the key device of FIG. 3D, respectively, inserted in cylinder locks, in accordance with embodiments of the present invention, with the plug pins moved to the shear line.
Figure 8A:
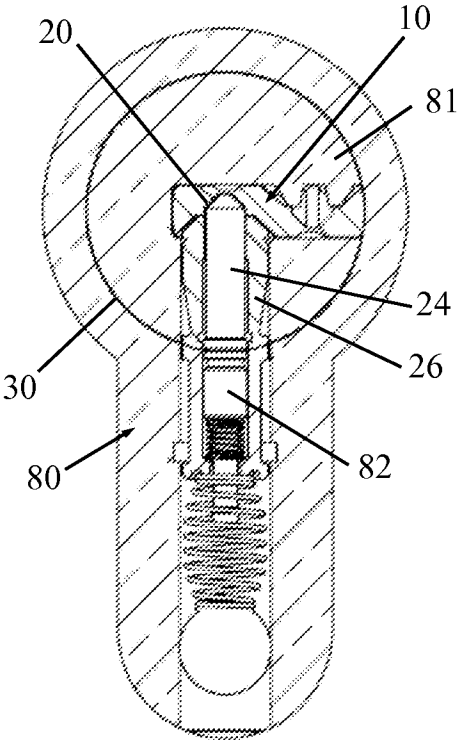

FIG. 8A illustrates the key device of any of the embodiments of the invention (such as key device 10) inserted in a cylinder lock 80, in accordance with an embodiment of the present invention. It is seen that non-MACS key cut 20 moves telescoping plug pins (inner pin 24 and outer pin 26) of a plug 81 to the shear line 30, with a driver pin 82 also moved to shear line 30.

FIG. 8B illustrates the key device of any of the embodiments of the invention (such as key device 10) inserted in a cylinder lock 90, in accordance with another embodiment of the present invention. Cylinder lock 90 employs the telescoping pin of FIG. 7B and the non-MACS key cut 20D of FIG. 3D. It is seen that non-MACS key cut 20D moves inner 75 and outer 78 telescoping pins of a plug 91 to the shear line 30, with a driver pin 92 also moved to shear line 30.

What is claimed is:

1. A key device for use with a cylinder lock that comprises a cylinder lock plug having telescoping plug pins, each telescoping plug pin comprising inner and outer pins, which are movable to a shear line against corresponding driver pins located in said cylinder lock, the key device comprising:

a generally elongate shaft portion comprising a key combination surface that has a plurality of key cut stations for forming telescoping key cuts at each key cut station, said key cut stations having a telescoping maximum adjacent cut specification (MACS) that defines a maximum depth of adjacent key cuts for interfacing with telescoping pins of a telescoping plug pin of a cylinder lock plug, wherein the telescoping MACS is defined as:

$$MACS = \frac{ID - CR}{2DI\left(\tan\frac{CA}{2}\right)}$$

wherein ID=outside diameter of the inner telescoping pin

CR=cut root (length of bottom ("root")) of the key cut

DI=depth increment

CA=cut angle (angle of cutting tool head used to create key cut; and a non-MACS telescoping key cut defined as a key cut that is not restricted by said telescoping MACS definition, formed at at least one of said key cut stations for interfacing with a first pin of a given telescoping plug pin, dimensioned to leave material in said elongate shaft portion for forming another key cut for interfacing with a second pin of said given telescoping plug pin and wherein a portion of said non-MACS key cut that interfaces with the first pin of the given telescoping plug pin has chamfered sides.

2. The key device according to claim 1, wherein said non-MACS telescoping key cut comprises at least one furrow formed in said elongate shaft portion, said furrow being arranged to interact with said first pin of said given telescopic plug pin.

3. The key device according to claim 1, wherein said non-MACS telescoping key cut has a depth deeper than a depth defined by said MACS.

4. The key device according to claim 1, wherein said non-MACS telescoping key cut is formed for interfacing with an inner pin of said given telescoping plug pin.

5. The key device according to claim 1, wherein said key combination surface comprises a support surface on which said telescoping key cuts are at least partially formable, and said non-MACS telescoping key cut is formed in said support surface.

6. The key device according to claim 5, wherein said non-MACS telescoping key cut is dimensioned to leave material away from said support surface for forming said other key cut for interfacing with the outer pin.

7. The key device according to claim 2, wherein said furrow is concave.

8. The key device according to claim 7, wherein said non-MACS telescoping key cut is aligned with or parallel to a longitudinal axis of said elongate shaft portion.

9. The key device according to claim 7, wherein said non-MACS telescoping key cut is tilted with respect to a longitudinal axis of said elongate shaft portion.

10. The key device according to claim 1, wherein said elongate shaft portion has telescoping key cuts formed thereon at the key cut stations at a distance from said non-MACS telescoping key cut.

11. The key device according to claim 1, wherein said elongate shaft portion has an additional key cut formed at the key cut station of said non-MACS telescoping key cut for interfacing with the second pin of said given telescoping plug pin.

12. A lock and key combination comprising:

a cylinder lock comprising:

a rotatable plug having a keyway, said plug comprising telescoping plug pins, each telescoping plug pin comprising inner and outer pins which are movable to a shear line against corresponding driver pins located in said cylinder lock; and a key device according to claim 1.

13. The key device according to claim 1, wherein a portion of said non-MACS key cut that interfaces with the second pin of the given telescoping plug pin has chamfered sides.

* * * * *